US005895901A

United States Patent [19]

Watanabe et al.

[11] Patent Number: 5,895,901

[45] Date of Patent: Apr. 20, 1999

[54] LONG-STROKE PUSH-ON SWITCH WITH REDUCED HEIGHT

[75] Inventors: Hisashi Watanabe; Koji Sako, both of Okayama-ken; Yasunori Yanai, Tsuyama; Hiroshi Matsui, Osaka, all of Japan

[73] Assignee: Matsushita Electric Industrial Co., Ltd., Osaka, Japan

[21] Appl. No.: 08/927,521

[22] Filed: Sep. 11, 1997

[30] Foreign Application Priority Data

Sep. 17, 1996 [JP] Japan ..... 8-244392

[51] Int. Cl.[6] ..... H01H 13/10

[52] U.S. Cl. ..... 200/534; 200/530

[58] Field of Search ..... 200/534, 535, 200/545, 406, 513, 516, 517, 530

[56] References Cited

U.S. PATENT DOCUMENTS

| | | | |
|---|---|---|---|
| 3,751,612 | 8/1973 | Hansen | 200/406 X |
| 3,773,998 | 11/1973 | Seeger et al. | 200/517 |
| 4,385,218 | 5/1983 | Nishida | 200/406 |
| 4,412,113 | 10/1983 | Mitsugi et al. | 200/406 |
| 4,755,645 | 7/1988 | Naoki et al. . | |
| 5,199,557 | 4/1993 | Brandt et al. | 200/406 |
| 5,228,561 | 7/1993 | Schroeder et al. . | |

FOREIGN PATENT DOCUMENTS

| | | | |
|---|---|---|---|
| 2740902 | 3/1979 | Germany | 200/535 |

*Primary Examiner*—Renee S. Luebke

*Attorney, Agent, or Firm*—Lowe Hauptman Gopstein Gilman & Berner

[57] ABSTRACT

A push-on switch includes a contact substrate provided thereon with a switch contact assembly, and an elastically deformable member disposed on the switch contact assembly. The push-on switch further includes a push button having a plate portion and a tubular portion. The tubular portion extends downward from the peripheral edge of the plate portion to surround an upper portion of the elastically deformable member. The plate portion is formed with a recess on an underside thereof at its center. A bottom surface of the recess is placed on a top surface of the elastically deformable member. The push-on switch further includes a tubular case fixed to the contact substrate. The tubular case supports the tubular portion of the push button so as to be vertically movable in the tubular case.

10 Claims, 6 Drawing Sheets

APPROVED BY DRAFTSMAN | O.G. FIG. | CLASS | SUBCLASS

PRIOR ART

LONG-STROKE PUSH-ON SWITCH WITH REDUCED HEIGHT

BACKGROUND OF THE INVENTION

1. Field of the Invention

The present invention relates to a push-on switch having a long operation stroke, which is utilized, for example, in a keyboard for an electronic device.

2. Description of the Prior Art

Recently, following size reduction and functional advancement of electronic devices, there has been an increased demand for push-on switches having long operation strokes for avoiding misoperation, in addition to having reduced size and thickness and providing enhanced feedback operation feelings.

Japanese Unexamined Patent Publication No. 3-214519 discloses a long-stroke push-on switch, which will be explained with reference to FIGS. 8 and 9A–9B.

FIG. 8 is a front-sectional view of the conventional long-stroke push-on switch. In the figure, numeral 1 denotes a box-type switch case made of resin by molding. At the bottom of the switch case 1, a pair of outer fixed contacts 2 and a central fixed contact 3 are fixed through insert molding. The outer fixed contacts 2 are connected to a connecting terminal 2A while the central fixed contact 3 is connected to a connecting terminal 3A. A movable contact member 4 in the form of an elastic metal thin plate is disposed on the outer fixed contacts 2.

FIGS. 9A and 9B are a plan and a front view of the movable contact member 4, respectively. As shown in these figures, the movable contact member 4 comprises a tongue contact portion 4A formed at the center by blanking the metal thin plate, and a peripheral portion 4C continuous with the tongue contact portion 4A at a root portion 4B. The tongue contact portion 4A is bent at the root portion 4B so as to protrude upward. The peripheral portion 4C is disposed on the outer fixed contacts 2 and thus electrically connected thereto, while the central tongue contact portion 4A confronts the central fixed contact 3 with a gap therebetween in the non-actuated state of the switch.

Numeral 6 denotes a dome-shaped spring member made of an elastic material, such as rubber. The spring member 6 has a dome-shaped hollow body 6A whose lower end is disposed on the peripheral portion 4C of the movable contact member 4. The spring member 6 further comprises an upward projection 6B and a downward projection 6C provided at the top of the dome-shaped body 6A. A push button 7 is placed on the upward projection 6B, while the downward projection 6C confronts the tongue contact portion 4A of the movable contact member 4.

The push button 7 comprises a lower portion 7A having a pair of projections 7B formed on the outer periphery thereof, and an upper portion 7C continuous with the lower portion 7A. The lower portion 7A is received in the switch case 1 such that the outer periphery of the lower portion 7A is vertically slidable along the inner periphery of a side wall 1A of the switch case 1 without inclination. Further, the projections 7B are slidably received in a pair of vertical grooves 1B formed on the inner periphery of the side wall 1A so as to be prevented from rotation and slipping off upward.

Now, an operation of the conventional push-on switch will be explained. When the top surface of the push button 7 is pressed by an operation button (not shown) of a using device, the dome-shaped spring member 6 in the switch case 1 is pushed downward by the push button 7 so as to be elastically deformed with tactile feedback to a user's finger. Then, the downward projection 6C of the spring member 6 pushes downward the tongue contact portion 4A of the movable contact member 4 so that the underside of the tongue contact portion 4A abuts the central fixed contact 3. Thus, electrical connection is achieved between the outer fixed contacts 2 and the central fixed contact 3, that is, between the connecting terminals 2A and 3A. Thereafter, when the push button 7 is released, the switch returns to the state shown in FIG. 8 due to elastic restoring forces of the dome-shaped spring member 6 and the movable contact member 4 so that the connecting terminals 2A and 3A are disconnected from each other.

As described above, in the foregoing conventional push-on switch, the dome-shaped spring member 6 in the switch case 1 is pushed downward by the push button 7 so as to be elastically deformed with the tactile feedback to the user's finger. However, for holding the push button 7 in the switch case 1 so as to be vertically movable along the inner periphery of the side wall 1A without inclination, a length H1 of the lower portion 7A of the push button 7 is required to be considerably large. Further, for reliably operating the switch, a length H2 of the upper portion 7C projected from the switch case 1 is required to be larger than an operation stroke of the switch. Accordingly, it is difficult to reduce the height of the switch.

Further, it is difficult to form, with high accuracy, the vertical grooves 1B on the inner periphery of the side wall 1A of the switch case 1 by molding with resin, particularly, in the small-size switch.

SUMMARY OF THE INVENTION

Therefore, it is an object of the present invention to provide an improved long-stroke push-on switch that can eliminate one or more of the foregoing problems.

According to one aspect of the present invention, a push-on switch comprises a contact substrate provided thereon with a switch contact assembly; an elastically deformable member disposed on the switch contact assembly; a push button having a plate portion and a tubular portion extending downward from the plate portion to surround an upper portion of the elastically deformable member; and a tubular case fixed to the contact substrate for supporting the tubular portion of the push button so as to be vertically movable in the tubular case.

It may be arranged that an underside of the plate portion of the push button is placed on a top surface of the elastically deformable member.

It may be arranged that the plate portion of the push button is formed with a recess on an underside thereof at its center, and that a bottom surface of the recess is placed on a top surface of the elastically deformable member.

It may be arranged that the tubular portion of the push button is provided at its lower end with pawl portions each projecting outward, and that the tubular case is formed on an inner periphery thereof with corresponding recesses for receiving therein the pawl portions so as to prevent the push button from coming off upward from the tubular case.

It may be arranged that the tubular portion of the push button is provided on an outer periphery thereof with protruding portions each extending over a full vertical length of the push button, and that the tubular case is formed on an inner periphery thereof with corresponding guide grooves for slidably receiving therein the protruding portions.

It may be arranged that the switch contact assembly comprises outer fixed contacts and a central fixed contact fixedly provided on the contact substrate, and that the contact substrate is provided thereon with arc-shaped ribs at portions other than near the outer fixed contacts, the arc-shaped ribs abutting an outer periphery of a lower end portion of the elastically deformable member and limiting a downward displacement of the push button by engagement with a lower end of the tubular portion of the push button.

It may be arranged that the switch contact assembly comprises outer fixed contacts and a central fixed contact fixedly provided on the contact substrate and a movable contact member which is placed on the outer fixed contacts at its peripheral edge portion, and that portions of the contact substrate confronting the movable contact member are set slightly lower than the outer fixed contacts.

It may be arranged that a small-diameter protruding portion is provided on a top surface of the plate portion of the push button at its center.

It may be arranged that concave portions are provided on a top surface of the contact substrate which abuts a lower end of the tubular case.

It may be arranged that the contact substrate is provided with coupling dowels on a peripheral edge portion thereof, and that the tubular case is fixed to the contact substrate by caulking the coupling dowels.

It may be arranged that the outer fixed contacts and the central fixed contact are fixed on the contact substrate by insert molding.

BRIEF DESCRIPTION OF THE DRAWINGS

The present invention will be understood more fully from the detailed description given hereinbelow, taken in conjunction with the accompanying drawings.

In the drawings:

FIGS. 9A and 9B are a plan and a front view showing a movable contact member employed in the conventional push-on switch, respectively.

DESCRIPTION OF THE PREFERRED EMBODIMENT

Figure 6:
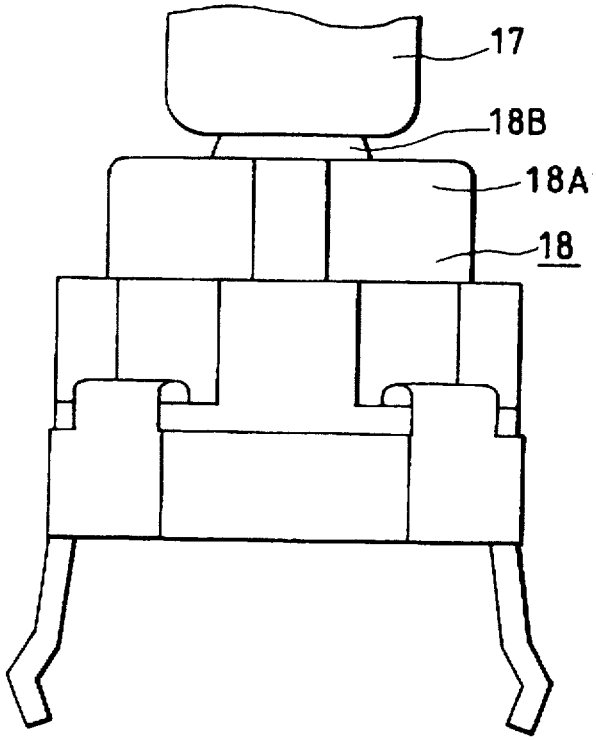
FIG. 6 is a front view of a push-on switch according to a second preferred embodiment of the present invention.
Figure 7:
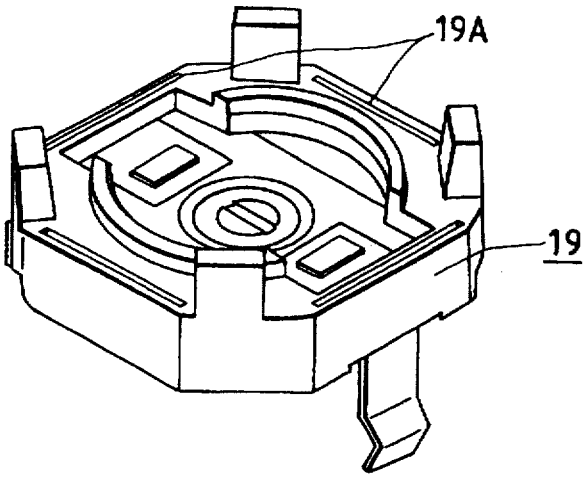
FIG. 7 is a perspective view of a contact substrate employed in a push-on switch according to a third preferred embodiment of the present invention.
Figure 8:
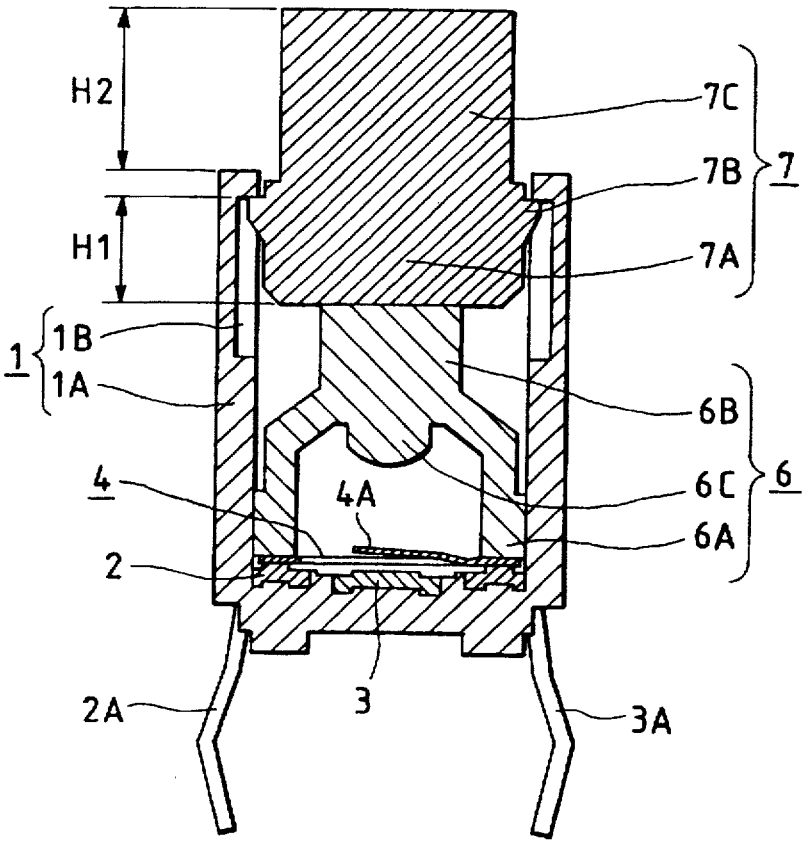
FIG. 8 PRIOR ART
FIG. 8 is a front-sectional view showing a conventional push-on switch.
Figure 6:
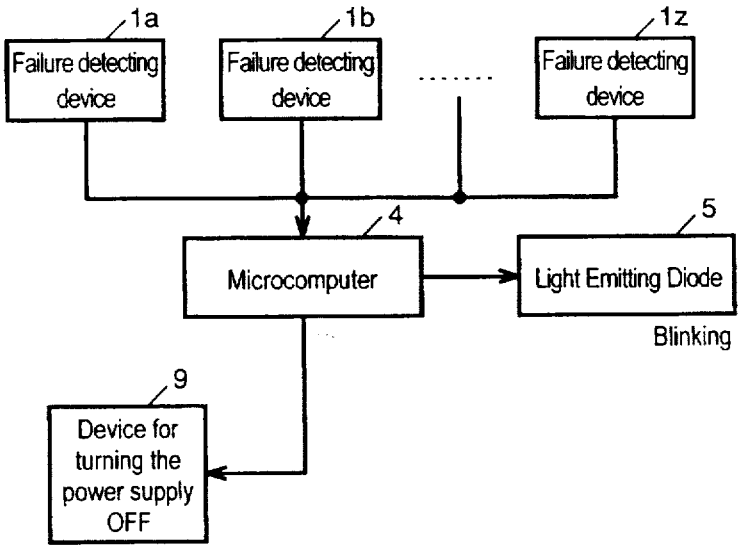

Now, the preferred embodiments of the present invention will be described hereinbelow with reference to FIGS. 1 to 7, wherein the same elements as those in FIGS. 8 and 9A–9B are represented by the same reference signs so as to omit detailed explanation thereof.

Figure 1:
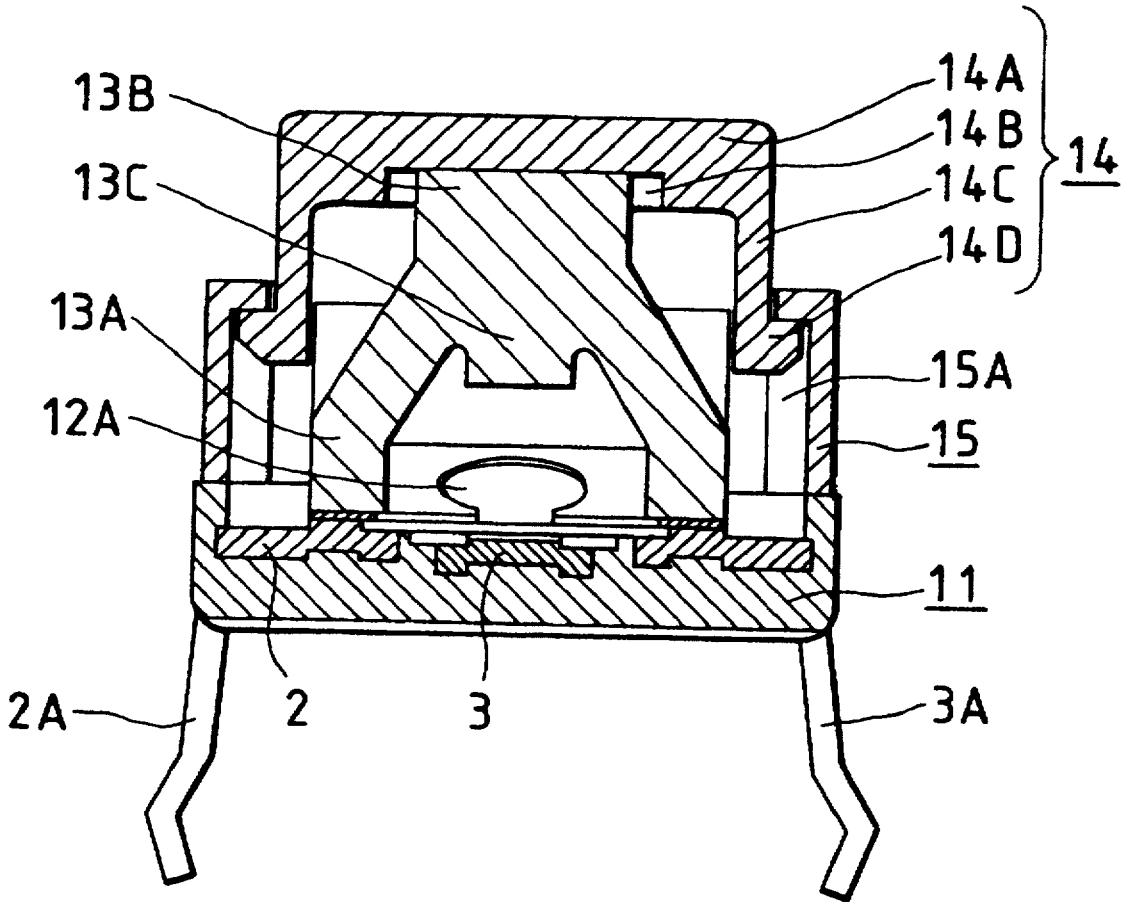
FIG. 1 is a front-sectional view showing a push-on switch according to a first preferred embodiment of the present invention.
Figure 2:
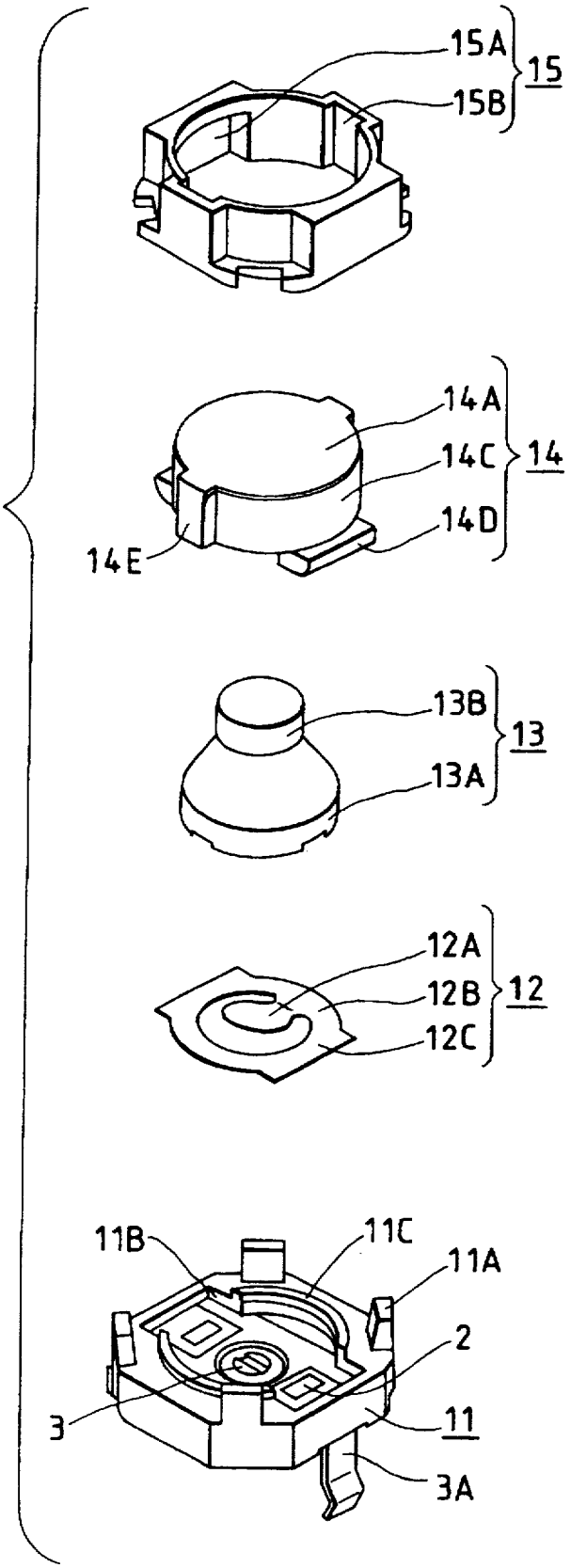
FIG. 2 is an exploded perspective view of the push-on switch shown in FIG. 1.

FIG. 1 is a front-sectional view of a push-on switch according to the first preferred embodiment of the present invention, and FIG. 2 is an exploded perspective view thereof. In the figures, numeral 11 denotes a contact substrate made of resin by molding. Like the bottom of the switch case 1 in the prior art, a pair of outer fixed contacts 2 and a central fixed contact 3 are fixed on the contact substrate 11 through insert molding. The outer fixed contacts 2 are arranged at opposite positions in a diametrical direction of the contact substrate 11 and connected to a connecting terminal 2A. On the other hand, the central fixed contact 3 is connected to a connecting terminal 3A. Each of the outer fixed contacts 2 comprises a central raised contact portion and a slightly lower peripheral portion around it. The contact substrate 11 is further provided with four coupling dowels 11A extending upward on the peripheral edge thereof.

A movable contact member 12 in the form of an elastic metal thin plate is disposed on the outer fixed contacts 2. The movable contact member 12 comprises a tongue contact portion 12A formed at the center by blanking the metal thin plate, and a peripheral portion 12B continuous with the tongue contact portion 12A at a root portion. The tongue contact portion 12A is bent at the root portion so as to protrude upward. The peripheral portion 12B has a pair of outward projected portions 12C which are disposed on the outer fixed contacts 2 so that the movable contact member 12 is electrically connected to the outer fixed contacts 2. The outward projected portions 12C are fitted into recessed portions 11B formed on the inner periphery of the contact substrate 11 so that positioning of the movable contact member 12 is achieved. The central tongue contact portion 12A confronts the central fixed contact 3 with a gap therebetween in the non-actuated state of the switch. Portions of the contact substrate 11 confronting the movable contact member 12 are set slightly lower than the foregoing contact portions of the outer fixed contacts 2. In this embodiment, the outer fixed contacts 2, the central fixed contact 3 and the movable contact member 12 form a switch contact assembly.

Figure 3:
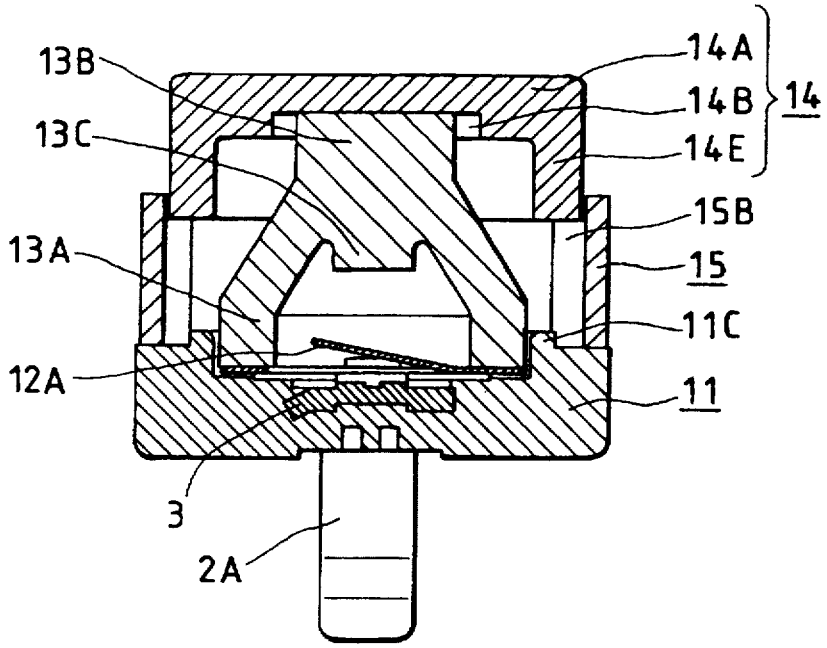
FIG. 3 is a side-sectional view showing the push-on switch shown in FIG. 1.

Numeral 13 denotes a dome-shaped spring member made of an elastic material, such as rubber. As shown in FIG. 3, the spring member 13 has a dome-shaped hollow body 13A whose lower end is disposed on the peripheral portion 12B of the movable contact member 12. The spring member 13 further comprises an upward projection 13B and a downward projection 13C provided at the top of the dome-shaped body 13A. Positioning of the spring member 13 is achieved by engagement between lower end portions of the dome-shaped hollow body 13A and a pair of arc-shaped ribs 11C fixed on the contact substrate 11.

A push button 14 is placed on the upward projection 13B, while the downward projection 13C confronts the tongue contact portion 12A of the movable contact member 12.

The push button 14 comprises a flat plate portion 14A. The flat plate portion 14A is formed with a recess 14B on the underside thereof at its center. The upward projection 13B of the spring member 13 is received in the recess 14B with a bottom surface of the recess 14B being placed on a top surface of the upward projection 13B. This arrangement ensures a stable positional relationship between the spring member 13 and the push button 14 even during the movement of the push button 14.

The push button 14 further comprises a hollow cylindrical portion or a tubular portion 14C which extends downward from the peripheral edge of the flat plate portion 14A so as to surround an upper portion of the spring member 13. The tubular portion 14C is provided at its lower end with a pair of pawl portions 14D each projecting outward. The pawl portions 14D are arranged at positions corresponding to the foregoing recessed portions 11B formed on the inner periphery of the contact substrate 11.

Figure 4:
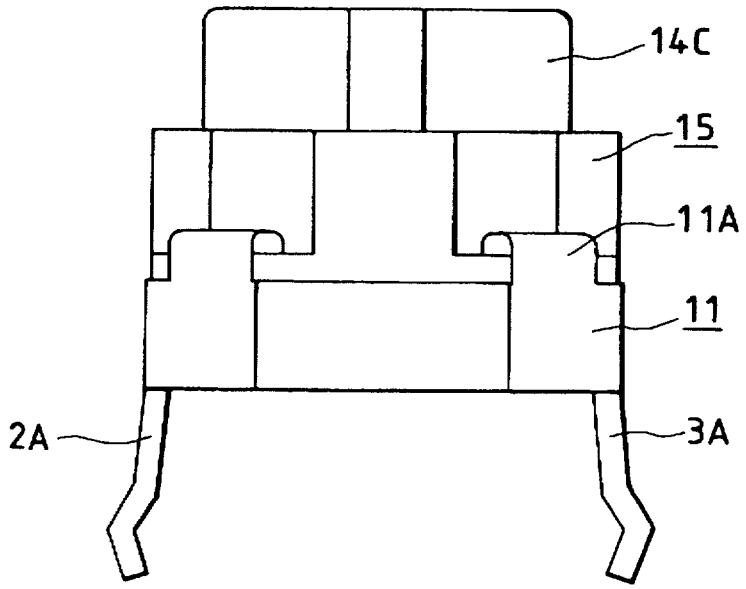
FIG. 4 is a front view showing the push-on switch shown in FIG. 1.

As shown in FIGS. 3 and 4, the tubular portion 14C of the push button 14 is received in a hollow cylindrical or tubular case 15 so as to be vertically slidable. The tubular case 15 is fixed on the contact substrate 11 by caulking the foregoing coupling dowels 11A. As shown in FIG. 1, the pawl portions 14D of the push button 14 are slidably received in a pair of vertical recesses 15A formed on the inner periphery of the tubular case 15 so that the push button 14 is prevented from slipping off upward by engagement between the pawl portions 14D and the upper walls of the vertical recesses 15A.

The push button 14 further comprises a pair of protruding portions 14E provided on the outer periphery of the tubular portion 14C and each extending over the full vertical length of the push button 14. The protruding portions 14E are arranged at opposite positions in a diametrical direction of the push button 14 which is orthogonal to a diametrical direction in which the foregoing pawl portions 14D are located. The protruding portions 14E are slidably received in a pair of vertical guide grooves 15B formed on the inner periphery of the tubular case 15 so as to assure the smooth vertical displacement of the push button 14 even with the reduced height of the switch.

Figure 5:
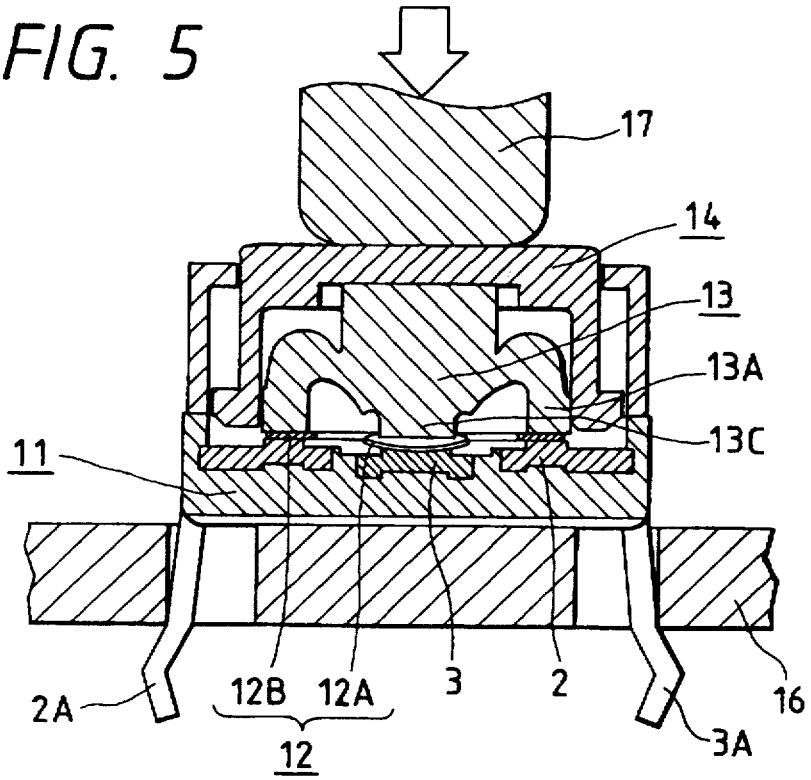
FIG. 5 is a front-sectional view showing the state of the push-on switch where an operation button is depressed.

Now, an operation of the push-on switch according to the first preferred embodiment will be described hereinbelow with reference to FIG. 5. In the figure, the switch is attached to a printed circuit board 16 of a using device.

When the top surface of the push button 14 is pressed by an operation button 17 of the using device, the dome-shaped spring member 13 on the contact substrate 11 is pushed downward by the push button 14 so as to be elastically deformed with tactile feedback to a user's finger. Then, the downward projection 13C of the spring member 13 pushes downward the tongue contact portion 12A of the movable contact member 12 so that the underside of the tongue contact portion 12A abuts the central fixed contact 3. Thus, electrical connection is achieved between the outer fixed contacts 2 and the central fixed contact 3, that is, between the connecting terminals 2A and 3A.

Simultaneously, the lower end of the dome-shaped hollow body 13A of the spring member 13 strongly presses the peripheral portion 12B of the movable contact member 12 against the outer fixed contacts 2. Since the contact portions of the outer fixed contacts 2 are slightly higher than the peripheral portions thereof and the associated portions of the contact substrate 11, the movable contact member 12 and the contact portions of the outer fixed contacts 2 are reliably contacted with each other so that the movable contact member 12 is not deformed.

Further, the downward displacement of the push button 14 is limited by engagement between the lower end of the tubular portion 14C and the arc-shaped ribs 11C on the contact substrate 11. Thereafter, when the depressing force applied to the push button 14 via the operation button 17 is released, the switch returns to the state shown in FIG. 1 due to elastic restoring forces of the dome-shaped spring member 13 and the movable contact member 12 so that the connecting terminals 2A and 3A are disconnected from each other.

As shown in FIG. 3, radially outward end portions of the central fixed contact 3 are partly bent downward. This aims to provide more reliable fixation of the central fixed contact 3 to the contact substrate 11 through insert molding for preventing the central fixed contact 3 from coming off.

Now, the second preferred embodiment of the present invention will be described with reference to FIG. 6. The second preferred embodiment differs from the first preferred embodiment in that the push button 14 is replaced by a push button 18. Specifically, as shown in FIG. 6, the push button 18 has a small-diameter protruding portion 18B provided on the top surface of a flat plate portion 18A at its center. The other structure is the same as that of the first preferred embodiment.

With this arrangement, it is possible to always push the center portion of the push button 18 via the operation button 17 of the using device so that more reliable depressing operation can be achieved.

Now, the third preferred embodiment of the present invention will be described with reference to FIG. 7. The third preferred embodiment differs from the first preferred embodiment in that the contact substrate 11 is replaced by a contact substrate 19. Specifically, as shown in FIG. 7, the contact substrate 19 is formed with concave portions 19A in the form of grooves or down steps on the top surface thereof which abuts the lower end of the tubular case 15. The other structure is the same as that of the first preferred embodiment.

With this arrangement, upon attaching the push-on switch to the printed circuit board 16 of the using device, invasion of soldering flux into the interior of the switch due to the capillary phenomenon can be fully prevented at the concave portions 19A.

As described above, according to the preferred embodiments of the present invention, the long-stroke push-on switch can be provided, which is low in height and easy to produce, causes less trouble upon attaching to the using device, and provides the smooth vertical displacement of the push button to assure an excellent feedback operation feeling.

While the present invention has been described in terms of the preferred embodiments, the invention is not to be limited thereto, but can be embodied in various ways without departing from the principle of the invention as defined in the appended claims.

What is claimed is:

1. A push-on switch comprising:

a contact substrate provided thereon with a switch contact assembly;

an elastically deformable member disposed on said switch contact assembly;

a push button having a plate portion and a tubular portion extending downward from said plate portion to surround an upper portion of said elastically deformable member; and a tubular case fixed to said contact substrate for supporting said tubular portion of said push button so as to be vertically movable in said tubular case wherein said switch contact assembly comprises outer fixed contacts and a central fixed contact fixedly provided on said contact substrate, and wherein said contact substrate is provided thereon with arc-shaped ribs abutting an outer periphery of a lower end portion of said elastically deformable member and limiting a downward displacement of said push button by engagement with a lower end of the tubular portion of said push button.

2. The push-on switch according to claim 1, wherein an underside of the plate portion of said push button is placed on a top surface of said elastically deformable member.

3. The push-on switch according to claim 1, wherein the plate portion of said push button is formed with a recess on an underside thereof at its center, and wherein a bottom surface of said recess is placed on a top surface of said elastically deformable member.

4. The push-on switch according to claim 1, wherein the tubular portion of said push button is provided at its lower end with pawl portions each projecting outward, and wherein said tubular case is formed on an inner periphery thereof with corresponding recesses for receiving therein said pawl portions so as to prevent said push button from coming off upward from said tubular case.

5. The push-on switch according to claim 1, wherein the tubular portion of said push button is provided on an outer periphery thereof with protruding portions each extending over a full vertical length of said push button, and wherein said tubular case is formed on an inner periphery thereof with corresponding guide grooves for slidably receiving therein said protruding portions.

6. The push-on switch according to claim 1, wherein said outer fixed contacts and said central fixed contact are fixed on said contact substrate by insert molding.

7. The push-on switch according to claim 1, wherein said switch contact assembly comprises outer fixed contacts and a central fixed contact fixedly provided on said contact substrate and a movable contact member which is placed on said outer fixed contacts at its peripheral edge portion, and wherein portions of said contact substrate confronting said movable contact member are set slightly lower than said outer fixed contacts.

8. The push-on switch according to claim 1, wherein a small-diameter protruding portion is provided on a top surface of the plate portion of said push button at its center.

9. The push-on switch according to claim 1, wherein concave portions are provided on a top surface of said contact substrate which abuts a lower end of said tubular case.

10. The push-on switch according to claim 1, wherein said contact substrate is provided with coupling dowels on a peripheral edge portion thereof, and wherein said tubular case is fixed to said contact substrate by caulking said coupling dowels.

* * * * *